US006578883B2

(12) United States Patent
Richmond

(10) Patent No.: US 6,578,883 B2
(45) Date of Patent: Jun. 17, 2003

(54) FRINGE KNOT TYING MACHINE

(76) Inventor: Freddie M. Richmond, 2132 Bowers Rd., Dalton, GA (US) 30721

( * ) Notice: Subject to any disclaimer, the term of this patent is extended or adjusted under 35 U.S.C. 154(b) by 23 days.

(21) Appl. No.: 10/016,735

(22) Filed: Oct. 30, 2001

(65) Prior Publication Data

US 2002/0108548 A1 Aug. 15, 2002

Related U.S. Application Data

(60) Provisional application No. 60/244,275, filed on Oct. 30, 2000.

(51) Int. Cl.[7] ..... B65H 69/04

(52) U.S. Cl. ..... 289/16; 289/1.2

(58) Field of Search ..... 289/1.2, 1.5, 16, 289/16.5, 18.1; 139/4, 385

(56) References Cited

U.S. PATENT DOCUMENTS

| | | | |
|---|---|---|---|
| 504,315 | A | 9/1893 | Arnold |
| 586,413 | A | 7/1897 | Arnold |
| 3,486,780 | A | 12/1969 | Card |

*Primary Examiner*—Gary L. Welch
(74) *Attorney, Agent, or Firm*—Sheldon H. Parker

(57) ABSTRACT

A machine for tying knots in a linear substrate that is woven simultaneously on the machine or prewoven and fed through the machine. A cutter system uses a knife and a looper independently operated by a series of clamp blocks and connecting links. A yarn needle carries the yarn to the looper for cross weaving. A roller assembly maintains the cut yarn in a taut position. An adjustable picker assembly having cams gathers a number of yarn strands together. A knot tying needle assembly has one end affixed to the machine with an open eyed movable needle for grasping the gathered strands. An adjustable knot tightener interacts with the movable needle to tighten the knot with the aid of an oscillating gear. A rake assembly moves the tied knots to the completion end of the machine.

6 Claims, 19 Drawing Sheets

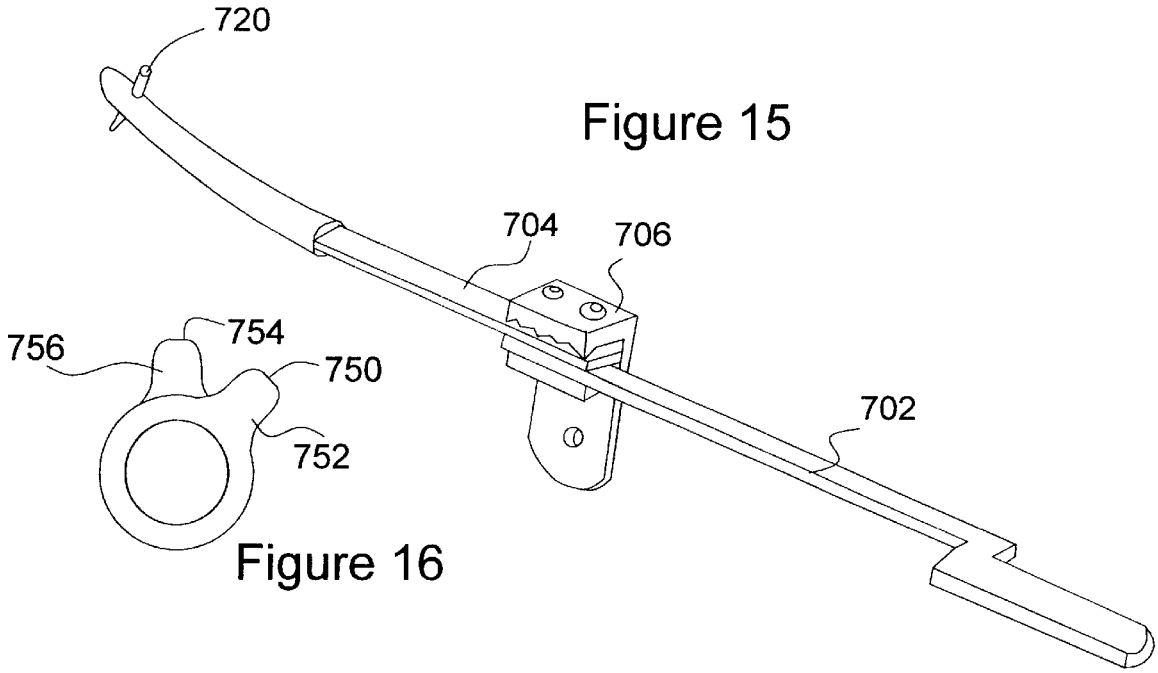
Figure 15
Figure 16
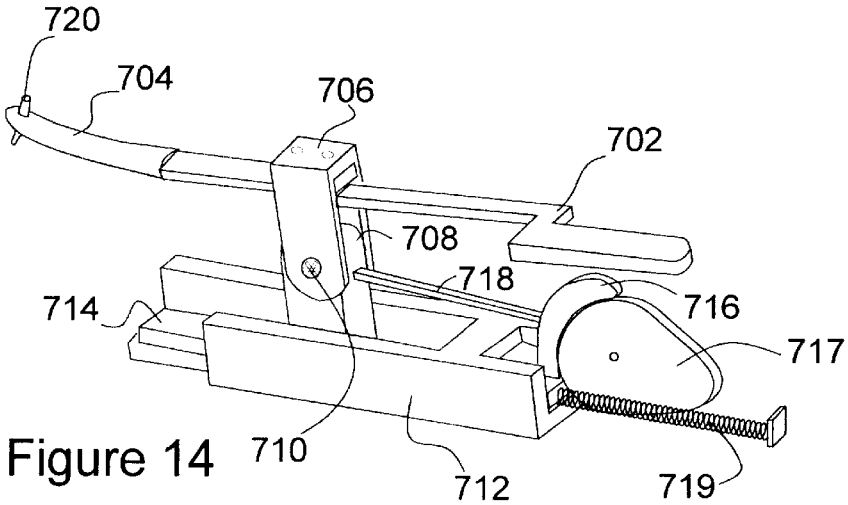
Figure 14

Figure 24
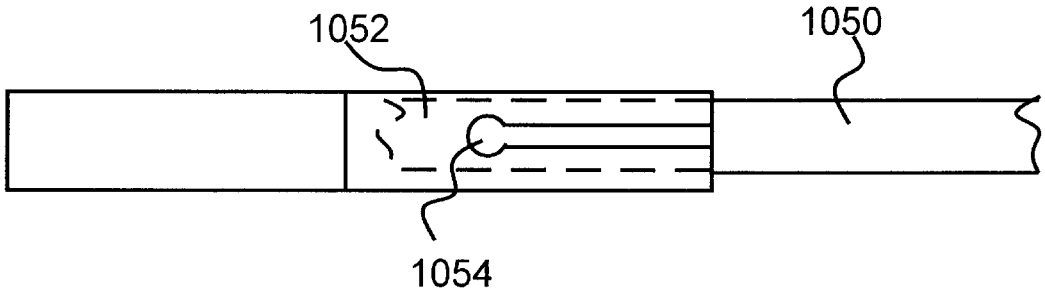
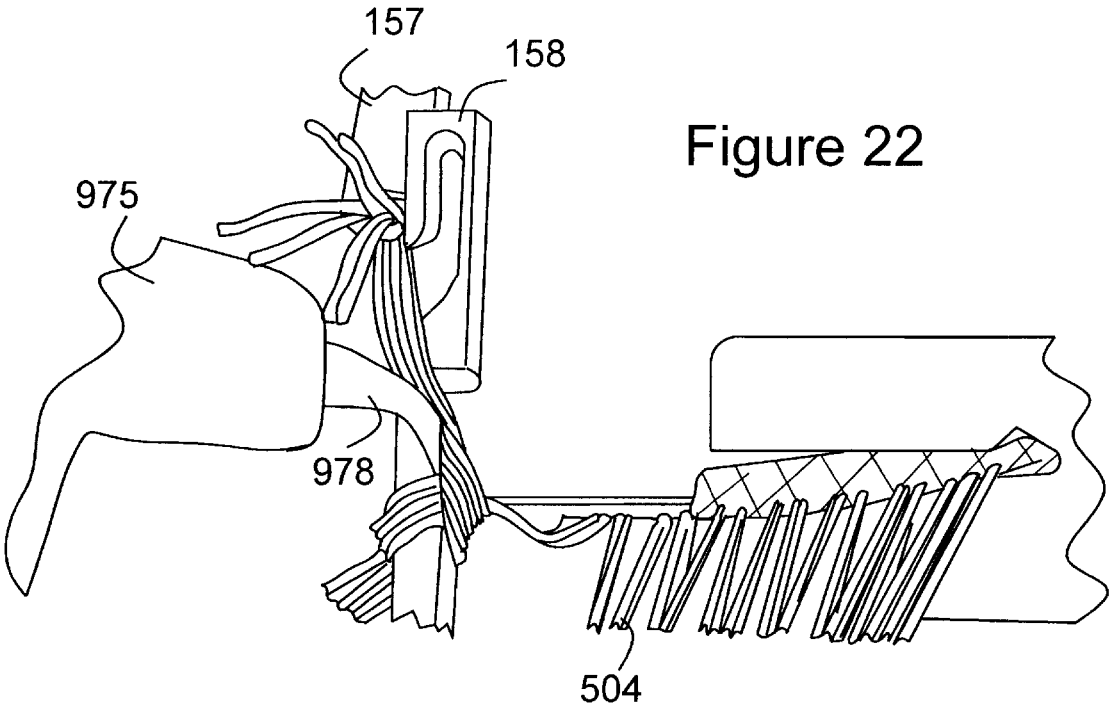
Figure 22

FRINGE KNOT TYING MACHINE

CROSS REFERENCE TO PRIOR APPLICATION

The present application claims the benefits under 35 U.S.C. 119(e) of provisional patent application Ser. No. 60/244,275, filed Oct. 30, 2000. This application incorporates by reference, as though recited in full, the disclosure of copending provisional application No. 60/244,275.

BACKGROUND OF THE INVENTION

1. Field of the Invention

This invention relates to an improved machine for making knotted fringe for use on rugs and the like.

2. Brief Description of the Prior Art

There are various machines for making narrow strips of fringe material that are used in the decoration and trimming of larger sheets of fabric, such as bedspreads and rugs. Most of these machines make the fringe material in which the fringe strands depend freely from the webs without being knotted. However, there is a demand for fringe material in which the strands are tied in knots. One example of a prior fringe knot tying machine is disclosed in U.S. Pat. No. 504,315 issued to Arnold, Sep. 5, 1893. However, this machine is limited to a plurality of cam actuated pins twisting the yarns in the plane of the fringe while cooperating with a cam actuating hook reciprocating in a plane perpendicular to the fringe plane to tie a knot simultaneous with the formation of the fringe.

In U.S. Pat. No. 3,486,780 a knot tying machine is disclosed to tie successive knots in strands of fringe material. This machine is used in conjunction with a fringe tufting machine, so that knots are tied in the fringe yarns immediately after the fringe is formed, in one continuous operation.

This knot tying machine incorporates a tying needle having an elongated eye adapted to reciprocate across the feed path of a moving strip of fringe material including a web from which the fringe yarns depend. A rotary looper element engages the free end portions of a strand or group of fringe yarns, and wraps the strand around the needle. A reciprocable hook member then projects through the eye of the protracted needle, engages the strand and pulls the free end portion through the eye. The needle then retracts to pull the free end portion of the strand through the wrapped portion of the strand to complete a half-hitch knot. The '780 patent also discloses a knot tightening mechanism in which the free end of the knotted strand is held by a reciprocal shoe while a forked tightener straddles the yarn strand and moves away from the free end against the knot. The operation of the various elements of the knot tying mechanism and the knot tightening mechanism are synchronized with the operation of a fringe tufting machine so that a strand consisting of a multiple number of fringe yarns may be tied into a single knot.

SUMMARY OF THE INVENTION

The disclosed fringe knot tying machine is an improvement upon prior art machines through by increasing the speed while dramatically reducing the maintenance required. The disclosed machine can tie knots in a linear substrate that is either woven simultaneously on the machine or prewoven and fed through the machine. The disclosed said cutter system is placed proximate the center of the machine and having a knife and a looper which are independently operated by a series of clamp blocks and connecting links. The looper moves to a receiving position to receive threads of yarn from a needle and back to a rest position to await a subsequent thread of yarn. The knife moves to cut the yarn that is retained on the looper. A yarn needle, located on a first side of the machine is moveable from the edge of the machine to the center of the machine to carry the yarn to the looper. When a substrate is woven simultaneously on the machine, the yarn needle also interacts to provide the cross weave. A roller assembly is used to maintain the cut yarn in a taut position. The roller assembly has a bristle roller and a grooved worm that interact to maintain the yarn in position. The grooved worm receives the yarn from the yarn needle and moves the yarn toward the completion end. While the yarn is still within the roller assembly, an adjustable picker assembly moves into position and gathers a predetermined number of yarn strands together to enable the knot tying needle to grasp the strands. The picker assembly is run by cams at the completion end of the machine.

A knot tying needle assembly has one end that is affixed to the machine and movable needle with an open eye that extends up to grasp the gathered strands. An adjustable, movable knot tightener, proximate the open eye, interacts the movable needle to tighten the knot as the tying needle finalizes the knot. A oscillating gear is used to move the needle in clockwise and counterclockwise directions to facilitate the knot tying. Once the gathered strands are grasped by the knot tying needle, a filler hook assembly, movably affixed to a second side of the machine, also grasps the strands. The filler hook moves upward and pulls the strands from the roller assembly. To prevent the knot from collapsing or moving along the knot tying needle, a needle rod is used to remain in contact with the knot until it is tied. A rake assembly, having a rotating rake, is positioned come in contact with the tied knots, moving the tied knots toward the completion end.

The cutter assembly, yarn needle, roller assembly, picker assembly, knot tying needle assembly, filler hook assembly, needle rod and rake assembly are synchronized with one another to tie fringe knots.

When the substrate is woven on the machine a needle assembly is used having a pair of neddles, a rocker and an adjustable cam assembly. The adjustable cam assembly determines the movement of said needles in relationship to one another. A packer assembly has a packer reed proximate neddles for compressing threaded yarn into the woven substrate and a packer cam. The packer cam is designed to activate the packer reed to avoid contact with the yarn needle.

BRIEF DESCRIPTION OF THE DRAWINGS

The advantages of the instant disclosure will become more apparent when read with the specification and the drawings, wherein:

FIG. 14 is a perspective view of the picker assembly;

FIG. 15 is a cutaway perspective view of the picker arm;

FIG. 16 is a front view of the picker arm lifting cams;

FIG. 22 is a perspective view of the needle forming the knot; and

FIG. 24 is a side view of the holder for use with a prewoven substrate.

DETAILED DESCRIPTION OF THE INVENTION

The tying of knots for carpet and other types of fringe was accomplished for generations by hand tying. In 1897 U.S. Pat. No. 586,413 was issued to C. W. Arnold, disclosing a machine that would tie fringe knots. In 1968 U.S. Pat. No. 3,486,780 issued to J. L. Card et al and further automated the process of fringe knot tying. U.S. Pat. No. 5,86,413 and U.S. Pat. No. 3,486,780 are incorporated herein as though recited in full.

Figure 1:
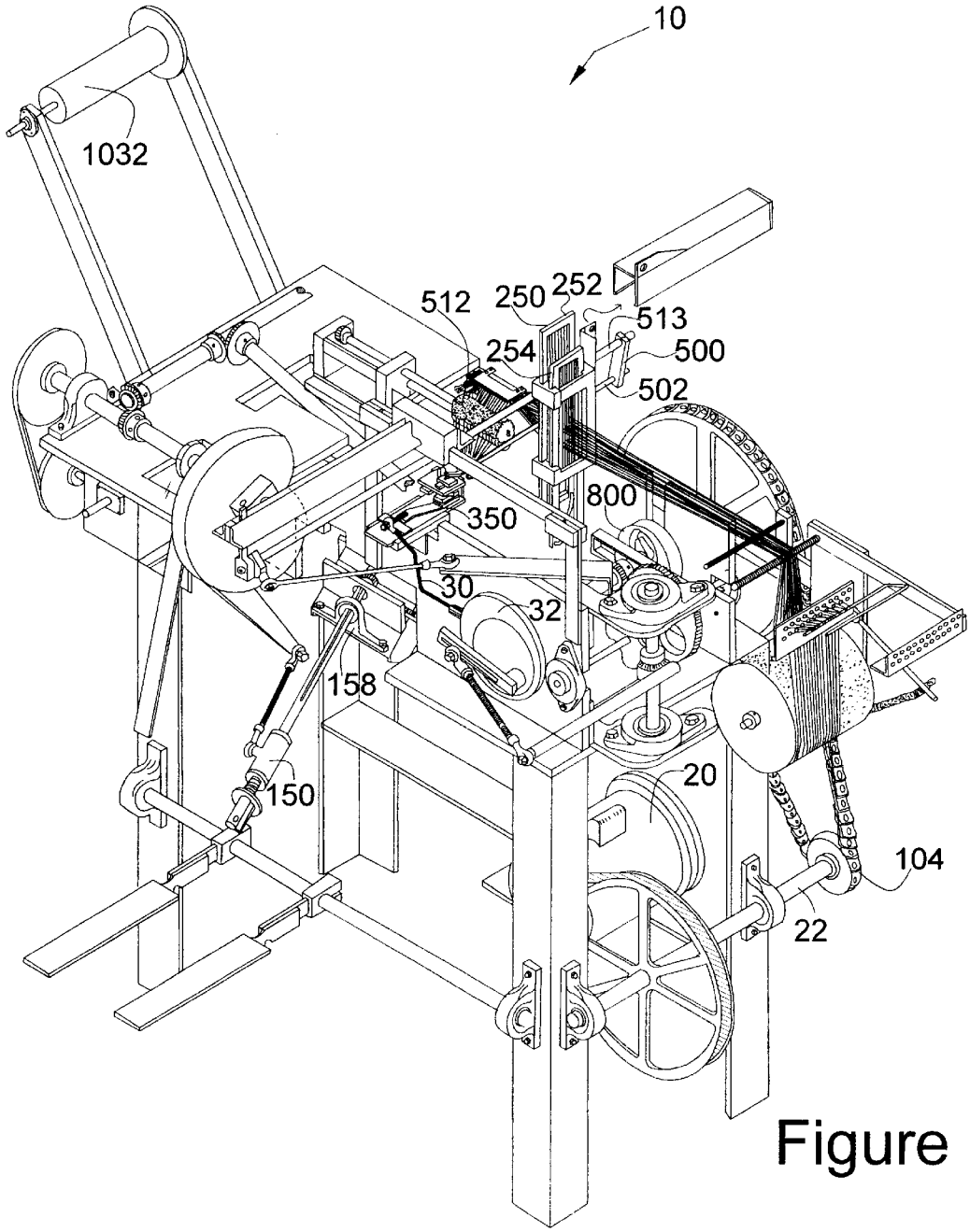
FIG. 1 is a perspective view of the disclosed fringe machine.

FIG. 1 illustrates the disclosed knot tying machine 10. For orientation purposes the motor 20 drives the main shaft 22 which drives the sprocket 24 which in turn drives the remaining elements of the machine. For ease of explanation, the improved portions of the machine 10 will be described individually and their placement noted in this overall view. The knots are formed into a linear base material which can be a woven yarn or a prewoven interface of some type of material. The description herein refers to the weaving of the yarn linear base material as is common with rug fringe. This weaving process is done using heddles having a unique rocker design as described hereinafter.

When a prewoven interface material is used, the heddles and other weaving process would not be used and the fringe would be knotted directly into the center line of the interface.

Knot Tightening Assembly

Figure 2:
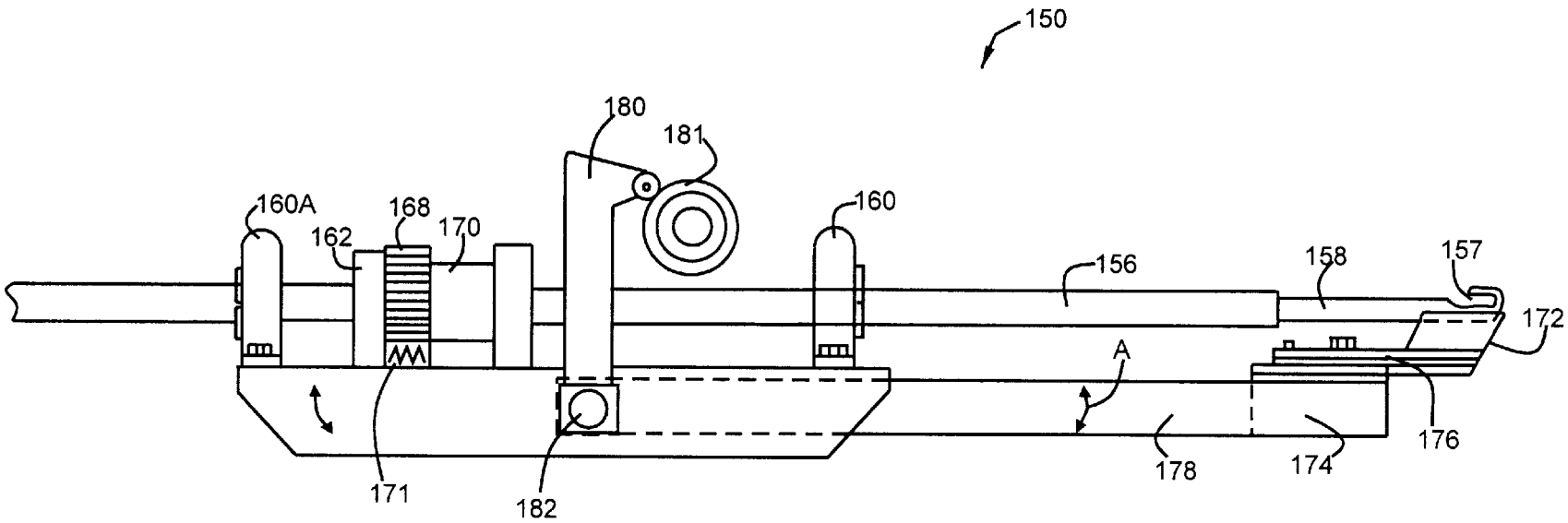
FIG. 2 is a detailed side view of the knot tying needle assembly.

The tightening needle used in the knot tying needle assembly 150 is illustrated in FIG. 2. The knot tying needle 158, contained in a casing 156, grabs the predetermined number of strands of yarn and maintains the yard in a secure manner until the knot is completed. The gear brackets 160A, 160B, 162A and 162B are rigidly secured, through welding or other means, to the base plate 170 and serve to maintain the rigidity of the casing 156. The casing 156 extends from the gear bracket 160A to the bracket 162A and then from the bracket 162B to the bracket 160A. In the space between the first great bracket 162A and the second great bracket 162B carries the spur gear 168 which contacts and rotates the needle 158. The spur gear 168 has been increased in size over prior art machines to increase the stroke distance as well as reduce maintenance. The prior art machines used a small gear in order to match the rotation of the gear with the other gear assemblies within the machine. Due to the use of a rack gear 171, the size of the spur gear can be increased with any gearing adjustments being done within the figure eight cam assembly disclosed in FIG. 5. In addition to increasing the stroke distance, the larger gear enables a greater space between the teeth, thereby increasing efficiency of the machine. Because of the amount of lint produced in textiles, the gears frequently get filled with lint, causing the machines to jam. By increasing the distance between the gear teeth, the interaction between the gears loosens the lint and enables the machines to run more effectively for longer periods. As the spur gear 168 is in contact with the knotting needle 158, the rotation of the spur gear 168 in response to the back and forth movement of the rack gear 171, turns the needle 158 thereby twisting the yarn strands for knotting. Without the rotation of the knotting needle 158, it would be impossible to form the knot.

The rocker shaft 180 extends into the base plate 158 where it is non-movably connected to the tightener rod 178 at the block 182. The tip 183 of the rocker shaft 180 moves in response to the beveled cam 184, thereby causing the rocker shaft 180 to rock back and forth. This back and forth rocking motion causes the tightener rod to move up and down in the direction of arrow "A". The tightener rod 178 is permitted limited movement within the base plate 170 order to permit the knot tightener 176 to move from proximate the tying needle 158 to spaced from the needle 158. Therefore, as the rocker shaft 180 is moved, by the cam 184, back toward the spur gear 168, the tightener rod 178 is raised, placing the knot tightener 176 proximate the needle 158. As the rocker shaft 180 moves in the opposite direction, the tightening rod 178 is dropped and moved away from the needle 158. Therefore, the knot tightener 176 is timed to come into contact with the knot and needle 158 as the needle 158 is pulling the yarn strands downward. Once the needle 158 has finished the downward movement, the knot tightener 174 is pivoted away from contact with the needle 158.

Figure 3:
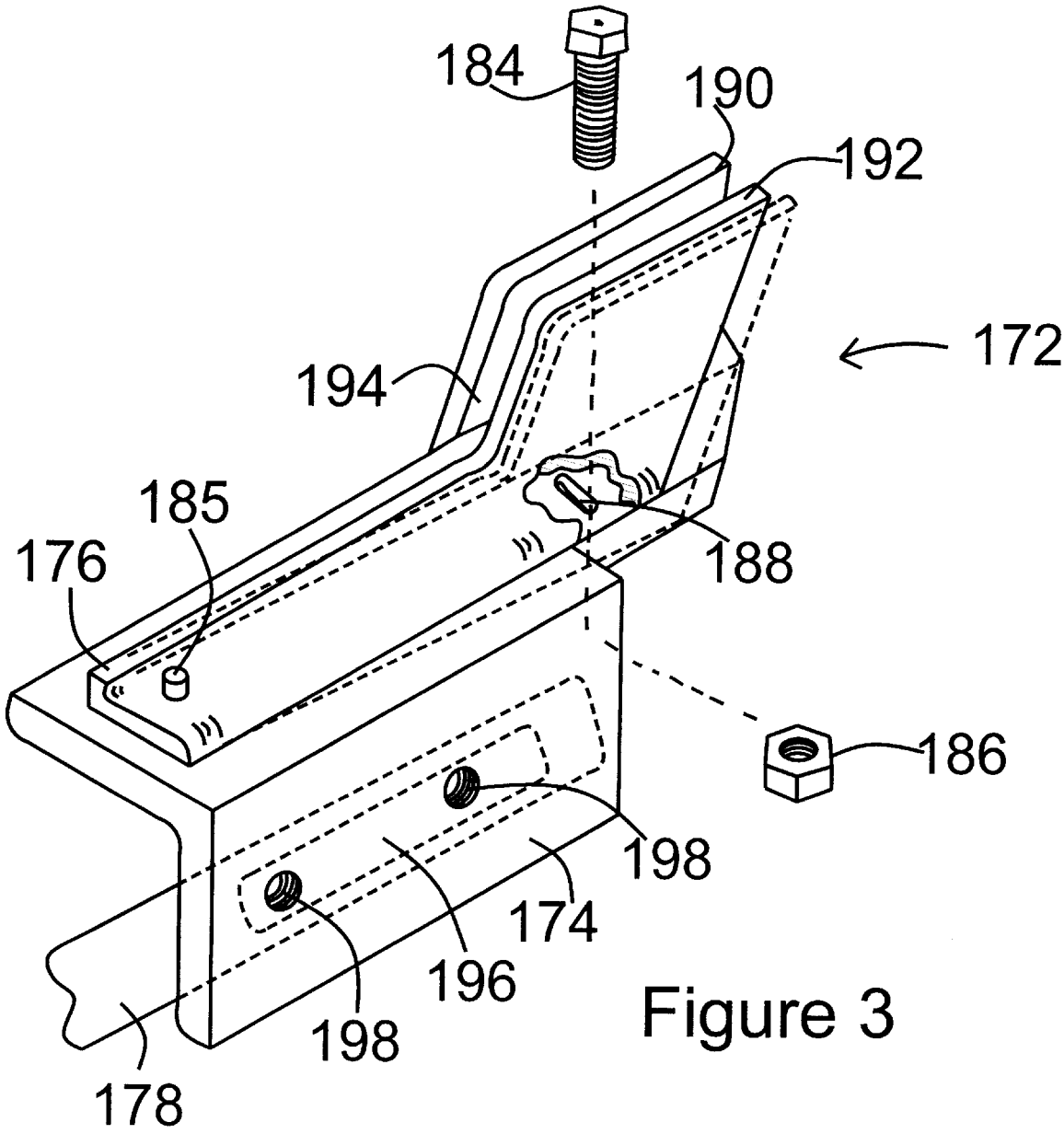
FIG. 3 is a perspective view of the knot tightening device.

The knot tightener 176, as illustrated in FIG. 3, is secured to a tightener L-plate 174, one leg of which attaches to the tightener rod 178 through use of receiving holes 198. As can be seen in this figure, the tightening rod 178 contains a rod notch 196 that has a length greater than the distance between the two receiving holes 198. This enables the knot tightener 172 to be positioned in multiple locations along the tightener rod 178. The tightener base plate 177 is secured to the second leg of the L-plate 174 through use of bolts or other securing means convenient to manufacture. The distal end of the knot tightener 176 has a tightener lip 192 extending at right angles from the base plate 177. A parallel tightener lip 190 is affixed directly to the edge of the base plate 177 by welding, bolts or can be molded as a one piece unit. A tightener channel 194 is formed by the parallel lips 190 and 192 to receive and force the knot to tighten as it is pulled through. The base plate 177 and tightener lip 192 are moveably affixed to the L-plate 174 through use of a bolt 184 and nut 186. The bolt 184 passes through a notch 186 that has a length grater than the diameter of the bolt 184. This enables the distance between the tightener lip 192 and the stationary tightener lip 190 to be varied, thereby accommodating different know sizes.

Rake

Figure 4:
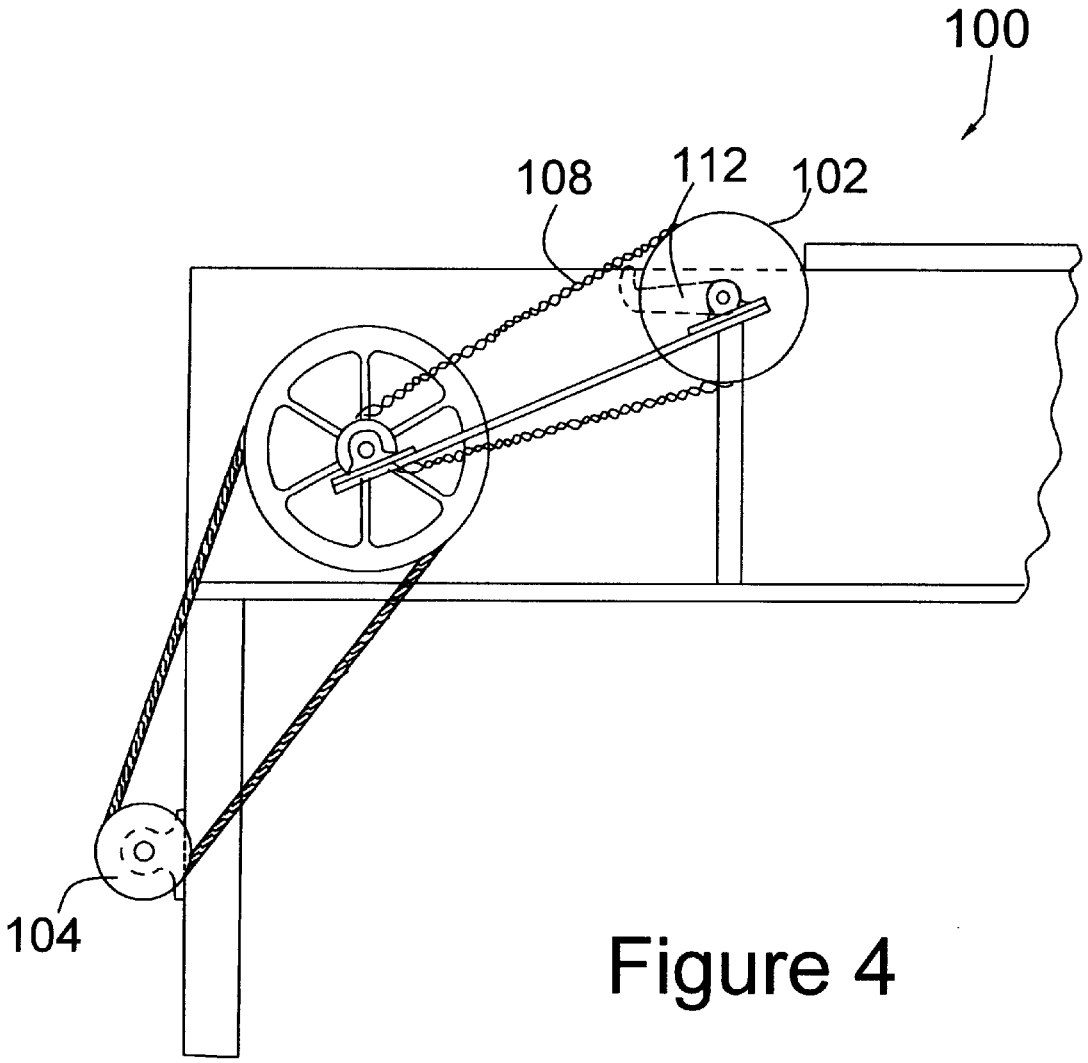
FIG. 4 is a side view of the rotary rake system.

In order to keep the knots moving along the line, a rake system 100 shown in FIG. 4 is provided to contact and direct the knots. The rake 112 is placed on a wheel 102 that rotates, via belt 108, and receives power from the motor 104. The rake 112 is a curved member that grabs the completed knot and moves it toward the rear of the machine.

8-Cam

Figure 5:
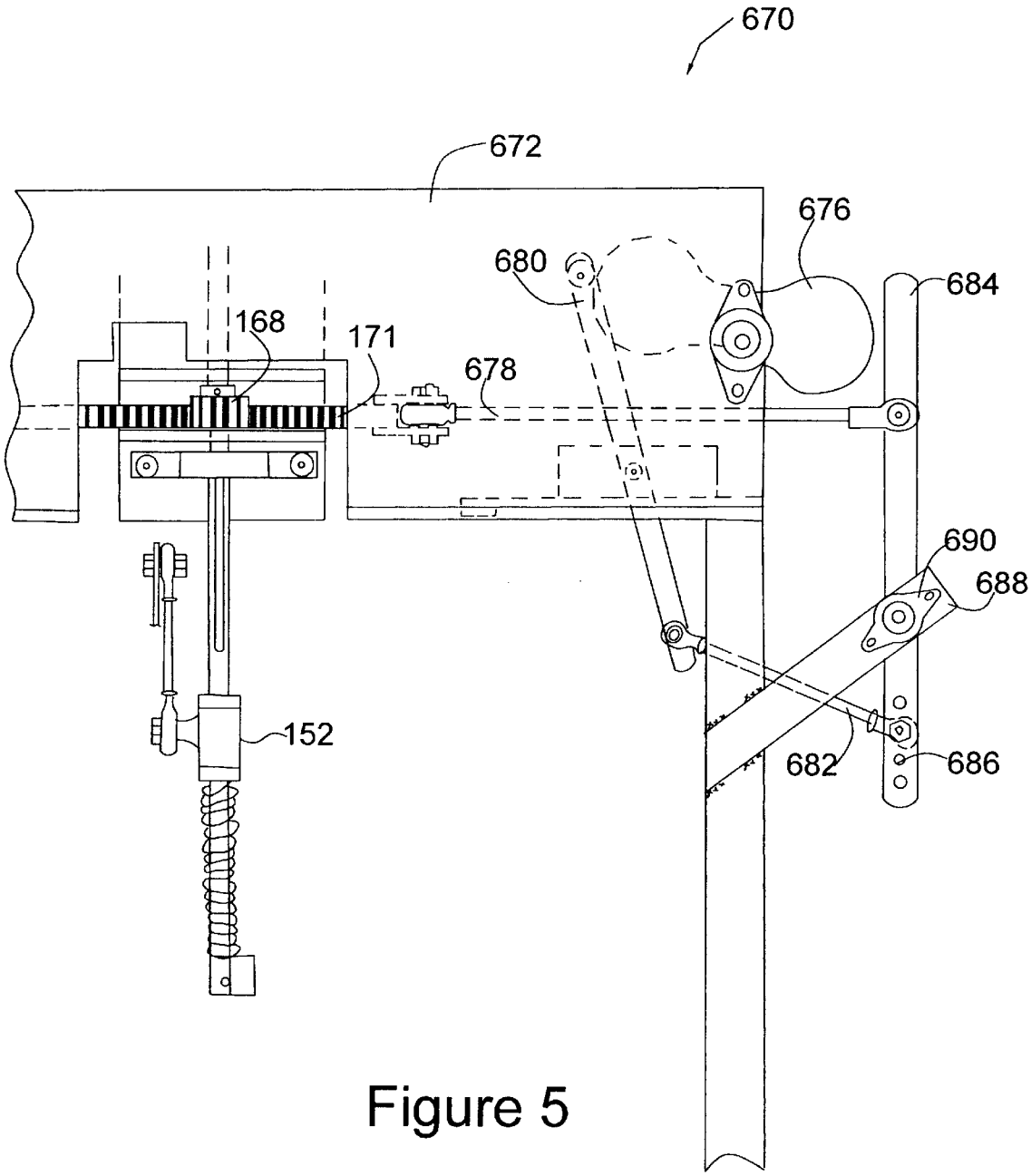
FIG. 5 is a side view of the figure eight cam assembly and its interaction with the lower knot tying needle assembly.
Figure 6:
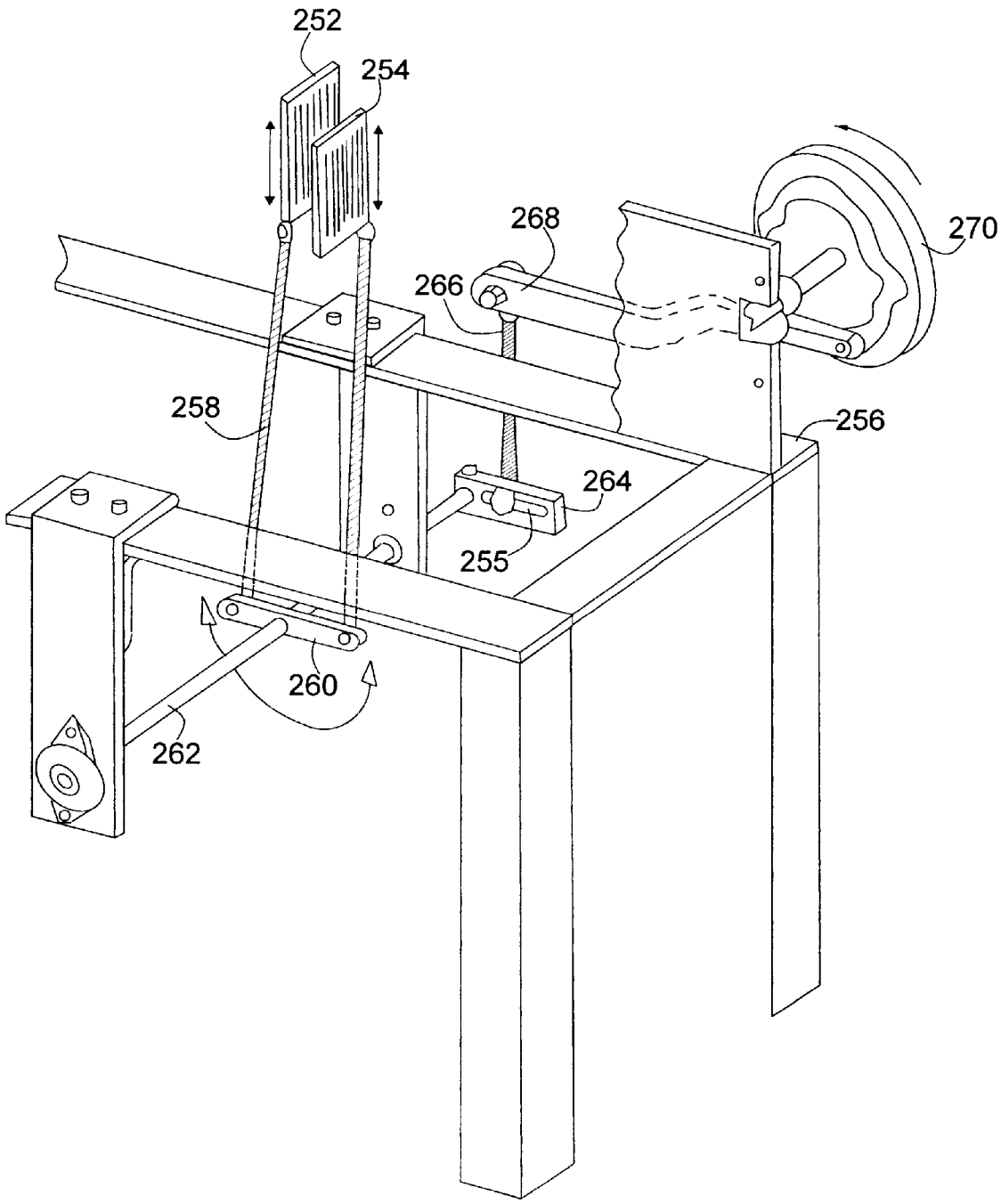
FIG. 6 is a perspective side view of the neddles and cam mechanism.

FIG. 5 illustrates the figure eight cam assembly 670 that drives the rack gear 171 in the knotting needle assembly 650, as illustrated in FIG. 2. The eight cam 676 is directly secured to the frame of the machine 10. The cam 676 is movably secured to the support plate 672 and is attached to the cam arm 680 at one end. The cam arm 680 is attached to the angled arm 682, which is, in turn, affixed to the rod arm 684. The rod arm 684 is provided with multiple adjustment holes 186 to enable the throw of the rod arm 684 to be changed. The arm rod 684 is maintained in position through use of a bracket 688 that permits rotation through use of a pivot 690. By changing the attachment position between the rod arm 684 and the angled arm 682, the throw of the rod arm 684 is changed, which in turn changes the gravel distance of the spur gear rod 678 and hence the rotation of the spur gear 168. Although this is an optimal design, other designs that accomplish the equivalent interaction of parts can also be incorporated.

Heddle Assembly

The yarn is separated for the weaving process through the use of heddles 252 and 254, using the same concept as a loom. In prior art machines, a pair of gears was used to move the heddles, and hence the yarn. Dual gears require additional machinery as well as requiring constant synchronizing. To increase the efficiency of the heddle timing, the prior art dual gears were replaced by a single cam 270 attached to a cam arm 268. The cam arm 268 is attached to a transfer rod 266 which is secured to an adjustment block 264 at notch 265. The notch 265 enables the rod 266 to be moved along the length of the adjustment block 264 in order to adjust the amount of rotation of the adjustment block 264. The rocker rod 262 is secured to the adjustment block 264 and to the rocker arm 260 and serves to transfer the motion created by the cam 270, through use of heddle rods 258, to the heddles 252 and 254. Therefore, when the cam arm 268 forces the distal end of the adjustment block 264 downwardly, it turns the rocker rod 262 in a clockwise direction. This in turn rotates the rocker arm 260 and causes the heddle 254 to lower and the opposing heddle 252 to rise. As the cam arm 268 rotates, the adjustment block 264 distal end rises, turning the rocker rod 262 in a counterclockwise position, thereby alternating the positioning of the heddles 254 and 252. As the transfer rod 266 is moved further from the rocker rod 262 along the notch 265, the degree of rotation, per cam 270 revolution, of the adjustment block 264 is decreased, thereby decreasing the movement of the heddles 252 and 254.

The timing of the heddle positioning is critical since the needle must be inserted between the yarn layers, secured and returned to its original position, at which point in time the heddles switch position and the process repeats.

Cutter

Figure 7:
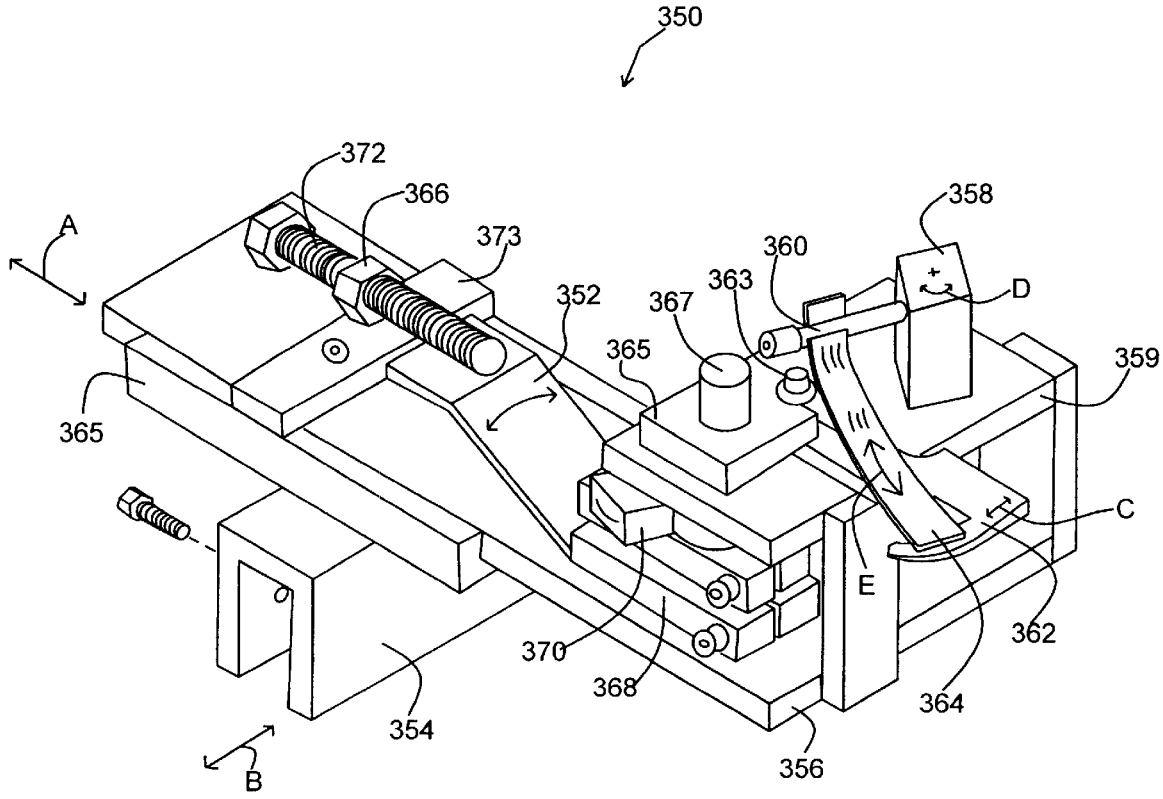
FIG. 7 is a perspective view of the knife cutting system in a cutting position.
Figure 8:
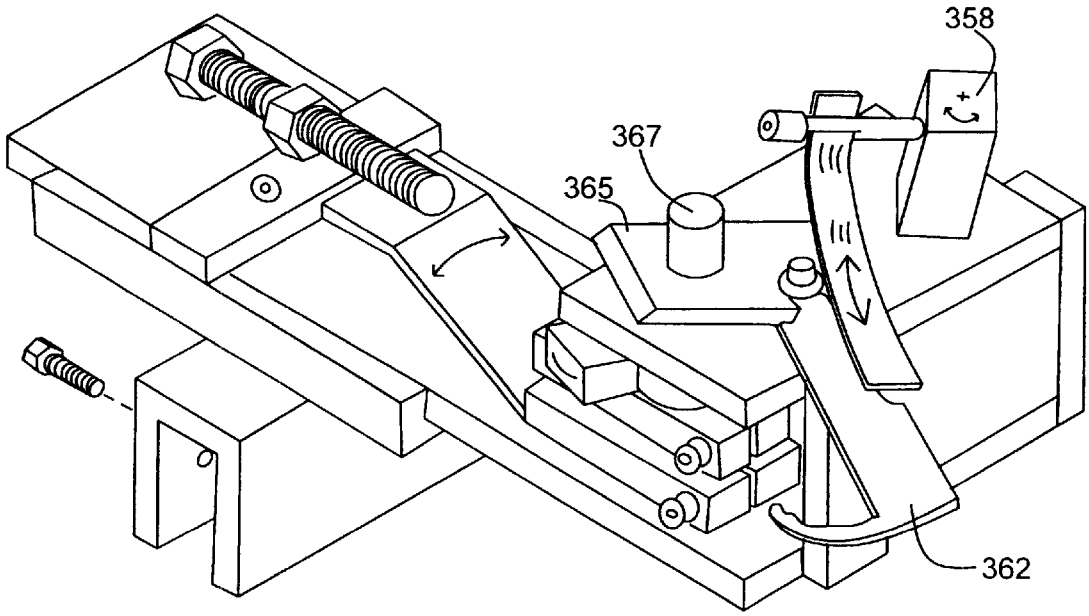
FIG. 8 is a perspective view of the knife cutting system in a receiving position.

One of the most difficult features in prior art machines is the cutting of the fringe. The novel cutting process, disclosed in FIGS. 7–9, rapidly cuts the loops of yarn into fringe. The disclosed system uses a novel cutter that prevents lint accumulation while enabling rapid cutting of the yarn, maintaining a cutting speed equal to the typing of the knots.

The disclosed cutter assembly 350 is mounted on the machine frame by U-bracket 354 and secured to the frame using bolts, welding or other equivalent means. By securing the U-bracket 354 using bolts, or other removable means, the cutter 350 is slidable along the frame, in the direction of arrow B, to enable the cutter 350 to be repositioned. The base plate 365, which is rigidly secured to the U-bracket 354, carries the chassis 356. The chassis 356 is moveably attach to the base plate 365 to enable it to be positioned along the base plate 365 and secured in the desired position through use of nuts, bolts or other means known in the art. By enabling the chassis 356 to be positioned on the base plate 365 in the direction of arrow A, the length of the fringe can be adjusted.

Figure 9:
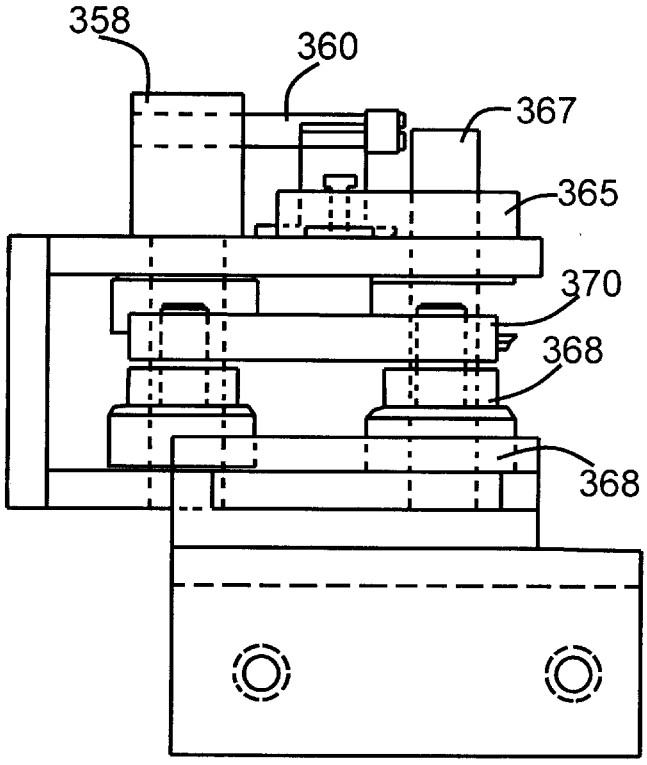
FIG. 9 is a back view of the interior of the knife cutting system.
Figure 9A:
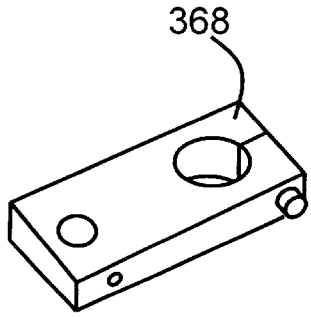
FIG. 9A is a perspective view of the clamp block used in the knife cutting system.

The adjustment bolt 372 is maintained at the proximal end above the chassis through the connection with the cam rod 30 illustrated in FIG. 1. The distal end of the bolt 372 is secured to the pivot arm 352. By rotating the adjustment bolt 372 within the securing nut 366, the pivot arm 352 can be adjusted. As the cam 32 rotates, it creates the action to pivot the bolt 372 which, in turn, serves to create the pivoting action of the worm 362 and pivot block 358. This action is not, as illustrated in FIG. 9, directly translated to the worm 362 and pivot block 358, but rather is transferred through a series of clamp blocks 368 and connecting links 370 that enable the rotation from the single source to move both the worm 362 and the pivot block 358 in separate, but synchronized motions. This design is one method of synchronizing the worm 362 and the pivot block 358 and others will be evident to those skilled in the art.

The worm 362 is adjustably attached to the worm block 369 through the use of the bolt 363. The worm block 369 rotates around the worm pivot 367 that is, in turn, in contact with the connecting link 370 and clamp blocks 368. The back and forth rotation of the worm block 369 causes the worm 362 to oscillate in the direction of arrow "C". The worm 362 is, in the portion of the cutting cycle illustrated in FIG. 7, overlapped by the knife 364 which moves in the direction indicated by arrow E. The knife 364 is held onto the knife block 358 through use of the stem 360, thereby causing the knife 364 to pivot in response to the pivoting of the knife block 358. The knife block 358 is attached to the pivot 352 arm through a rod system that causes the knife block 358 to move in response to the movement of the central pivot arm 352. The knife block is set back from the support edge 359 about 5/16 of an inch. In order to maintain the optimum angle between the knife 364 and the worm 362, the stem 360 is preferably maintained at about a 2 degree angle from the support edge 359.

Figure 11:
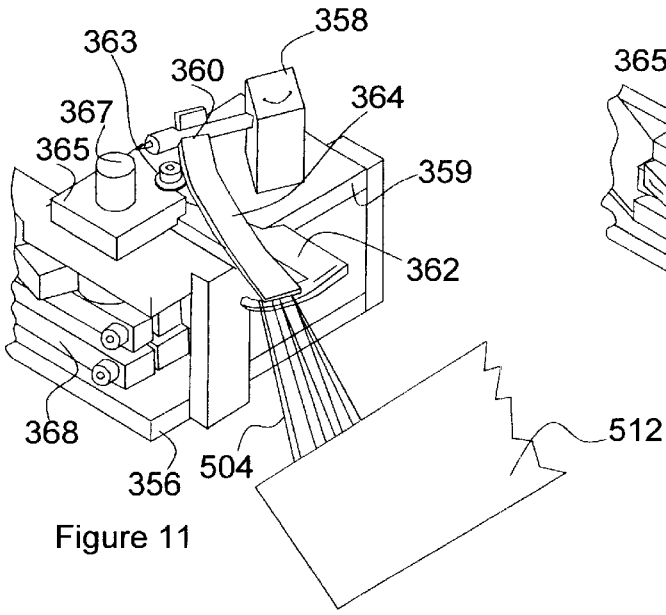
FIG. 11 is a perspective view of the cutter cutting the yarn.
Figure 10:
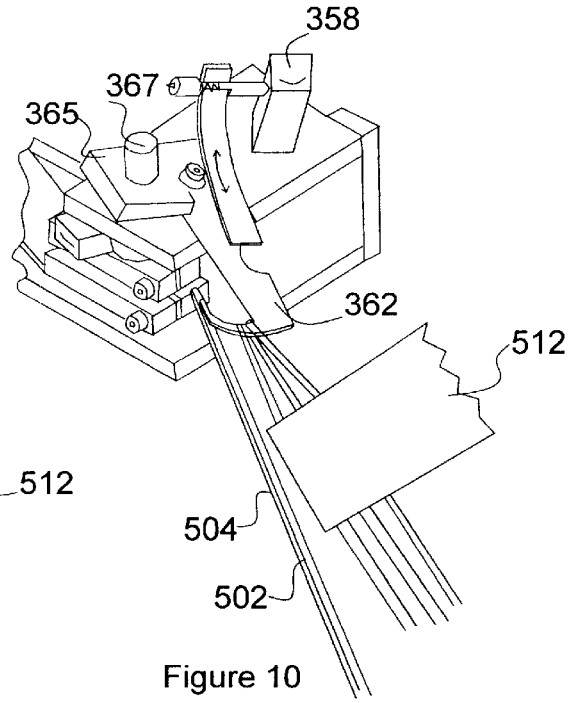
FIG. 10 is a perspective view of the yarn being gathered on the cutter worm.

As stated heretofore, all movement is derived from the pivot arm 352, thereby enabling the timing between the worm 362 and knife 360 to be synchronized. As seen in FIGS. 10 and 11, as the needle 504 brings the yarn 502 in the engaged position of FIG. 10, the worm 362 moves toward the needle, sliding between the yarn 502 and the needle 504. As the needle 504 retracts into the disengaged position, the yarn 502 remains looped on the worm 362. As the needle 504 withdraws, the looper 362 rotates, in the direction of Arrow F, to a position that enables the end of the looper 362 to engage the next strand of yard 502.

Once a predetermined number of yarn 502 strands are gathered on the looper 362, the knife 364 moves into the cutting position as illustrated in FIG. 11, slicing the strands of yarn 502.

In order to prevent the yarn 502 from simply falling loosely, the brush 510 is constantly in motion in a clockwise direction. The movement of the brush maintains the yarn 502 between the brush 510 and a cam, as described in conjunction with FIG. 12 herein.

Brush and Worm

Figure 12:
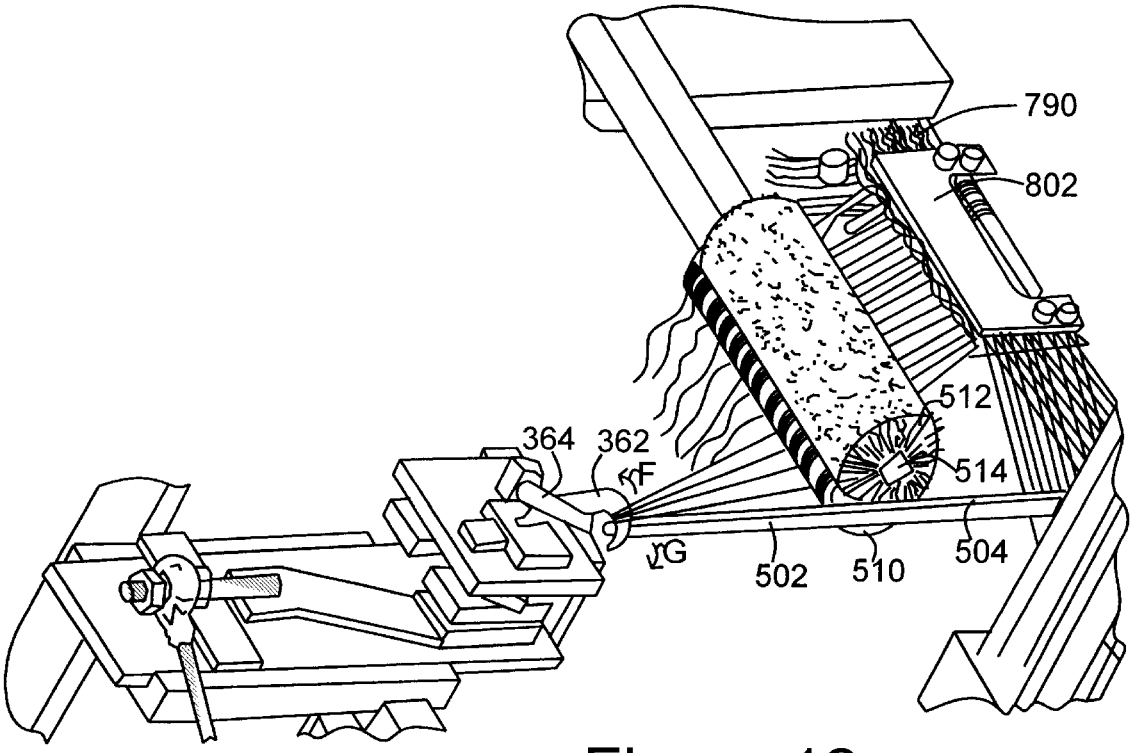
FIG. 12 is a perspective view of the cutting and tying portion of the machine.

The brush 512 and worm 510 are illustrated in FIG. 12 with the cross bracing from the machinery removed to enable the cutter and yarn to be viewed clearly. The yarn 504 is transferred from the needle 502 to the looper 362 by the tip of the worm 362 passing between the needle 502 and the yarn 504. This requires exact alignment between the needle 502 and the looper 362 to prevent the looper 362 from striking the needle 502 as it moves to pick up the yarn 504. The rest position for the looper 362 must place the tip of the looper 362 approximate the yarn 504, in the direction of arrow F, but not at the point of interference. Once the needle has reached full extension, the looper 362 travels to the point of interaction, in the direction of arrow G, engaging the yarn 504. As the needle 504 withdraws, the yarn 504 remains on the looper 362. Once a predetermined number strands of yarn 504 have been gathered on the worm 362, the knife 364 moves into the position illustrated in FIG. 11, cutting the yarn 504.

Once the yarn forming the webbing of the fringe is woven and the fringe yard inserted, the web 790 is moved into the web support 802 which serves to support the web during the knot tying procedure.

To maintain the yarn 504 strands in a taut, but knotable, condition, the strands of yarn 504 are picked up and moved to the knot tying needle 158 by the combination of a worm 510 and a bristle roller 512. The worm 510 is grooved in a helical pattern that continually moves the yarn 504 toward the needle 158 as it rotates. The bristles of the roller 512 are in contact with the worm 510 to prevent the strands of yard 504 from dropping out of reach of the needle 158. The end of the worm 510 is positioned such that when the looper 362 is in the rest position, the yarn 504 is contacted by the end of the worm 510, directing the yarn 504 along the grooves in the worm 510.

The end of the worm 510 can be either cut, with the leading edge of the helix engaging the yarn 504. Alternatively an additional end can be added to the cut end of the worm 510 to engage and bring the yarn 504 onto the worm. The design of the alternative end will be evident to those skilled.

Picker

Figure 13:
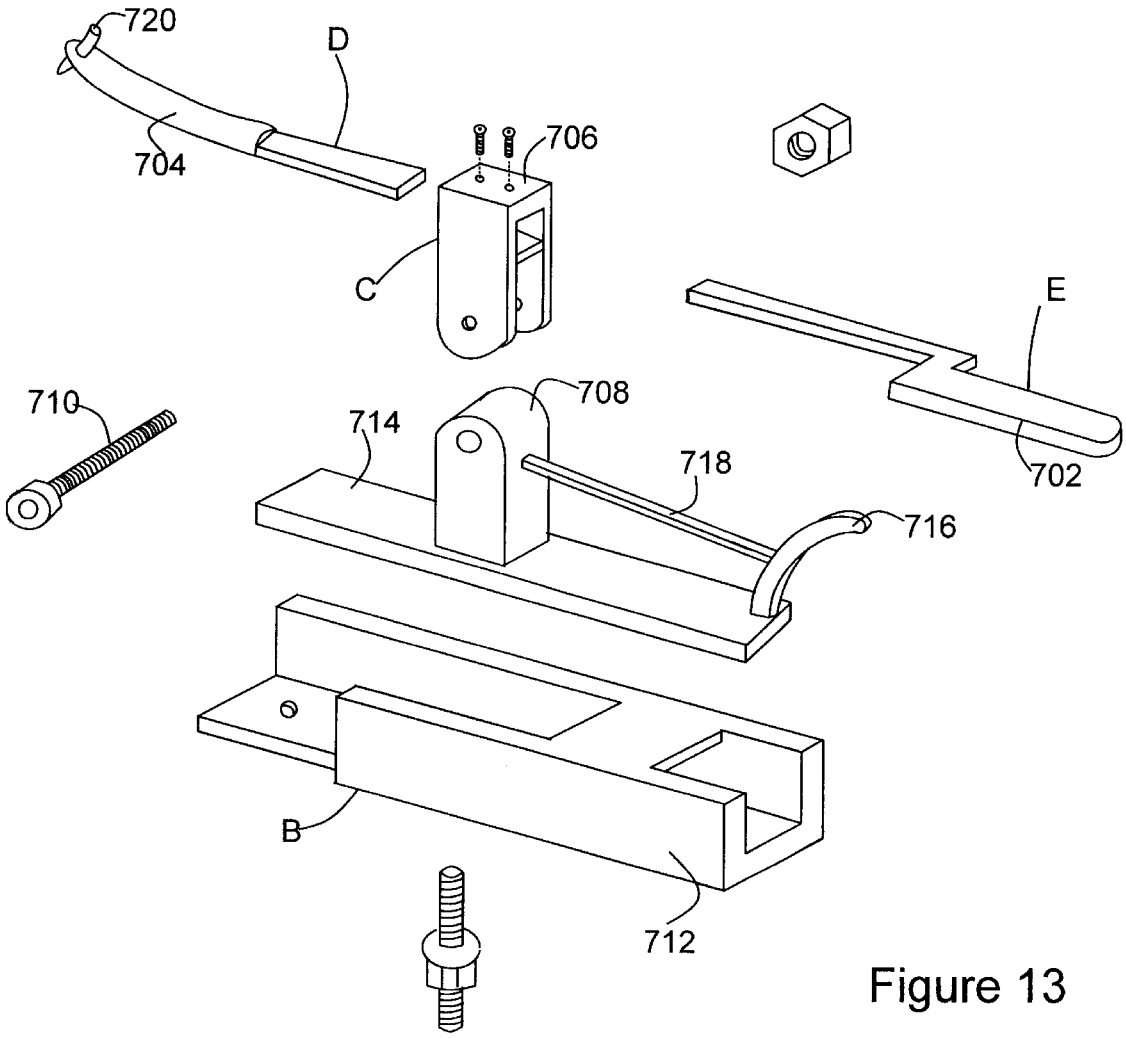
FIG. 13 is an exploded perspective view of the picker assembly.

In order for the knot to be tied, the stands of yarn 504 must be gathered and consolidated to have a width capable of being grasped by the needle 158. Additionally to provide aesthetic consistency within the length of fringe, an identical number of yarn strands 504 must be knotted each time. This is accomplished through use of an oscillating arm referred to herein as a picker assembly 700 and illustrated in FIGS. 13–15. The assembly 700 is affixed to the machine 10 through use of the base plate 712. Within the base plate 712 is placed the rocker plate 714. The rocker plate 714 consists of the pivot 708, cam arc 716 and transfer bar 718. The front pick arm 704 and rear pick arm 702 are separate units which are secured within the rocker 706. By using both a front pick arm 704 and rear pick arm 702, the reach, and therefore the number of yarn strands 504 selected, can be adjusted. The front pick arm 704 has a yarn pick 720 which is used to catch the predetermined number of yarn strands and pull them toward the adjacent strands. As stated heretofore, the cut strands of yarn 504 are maintained in a taut position by placement between the bristle roller 512 and the worm 510. The bristles of the upper roller 512 enable only the strands of yarn 504 engaged by the yarn pick 720 to be gathered, while maintaining the non pulled threads between the rollers 512 and 510. The upper portion of the pick arm assembly, including pick arms 704 and 702 are moved forward and backward through use of an egg shaped cam 717 that interacts with the cam arc 716. As the elongated portion of the egg shaped cam 717 comes in contact with the cam arc 716, it pushes the rocker plate 714 forward toward the yarn strands 504. As the rounder, narrower portion of the cam 717 rotates into position, the spring 719 pulls the rocker plate 714 back into the position illustrated in FIG. 14. The spring 719, while having sufficient resistance to pull the rocker plate 714 back into position, it must not exert enough force to hamper the movement of the rocker plate 714.

In addition to the rocker plate 714 moving back and forth, the front pick arm 704 must drop to contact the yarn 504 at the time the rocker plate 714 is at its further most proximal position. In order to achieve the up/down movement of the pick arm, lifter cams 750 and 754 are used to lift and drop the pick arms 702 and 704 at the appropriate time. In order to achieve the desired action, it is critical that the pick arms are rigidly secured to the rocker 706 which is free to rock on the pivot 708 through use of the pivot pin 710.

As can be seen in this Figure, the back portion 703 of the back pick arm 702 is offset from the remaining pick arm 702 in order to avoid contact with the cam 717 and to place the pick arm 702 in contact with the lifting cams 752 and 750. The lifting cams 750 and 754, illustrated in FIG. 16, are proximate the egg cam 727 and can either be geared separately or identical to the cam 717. The back portion 703 of the back pick arm 702 is positioned to be in contact with the lifting cams 750 and 754 during their rotation cycle. Each of the lifting cams 750 and 754 each have a flange 752 and 756 respectively, that when rotated to be in contact with the back portion 703 of the back pick arm 702, lift the back pick arm 702 and drop to front pick arm 704. The use of dual lifting cams 750 and 754 enable the amount of time the back portion 703 of the back pick arm 702 is raised or dropped to be controlled by separating the two flanges 752 and 754. The closer the two flanges 752 and 754 are to one another and shorter the time period the back portion 703 is raised and conversely the further the two flanges 752 and 754 are separated the longer the back portion is raised. It should be noted that the timing on the pick arm, as well as all moving parts of the disclosed machine, is critical. The yarn pin 720 must be dropped precisely at the appropriate time to pull the strands together to allow the strands to be knotted.

Yarn Needle

Figure 17:
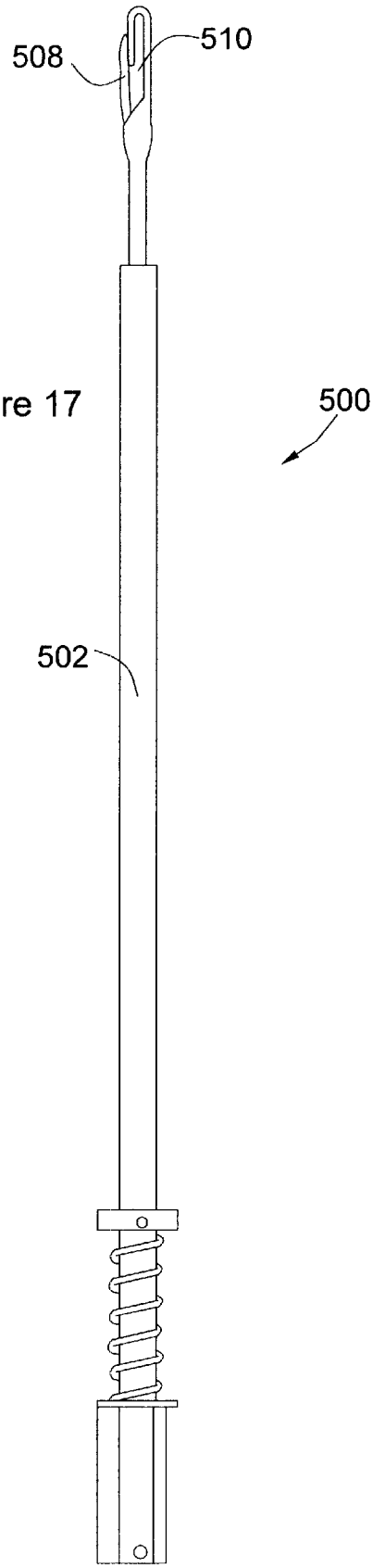
FIG. 17 is a side view of the weaving needle.

One of the many unique features of the disclosed machine is the positioning of the yarn needle 502. As seen on the over view of the machine of FIG. 1, the yarn needle assembly 500 is on the opposite side of the machine 10 than the cutter assembly 350. The yarn needle 502 of the assembly 500, illustrated in detail in FIG. 17, comprises a needle 502 with a closure tab 508 to maintain the yarn 504 within the needle eye 510 during the weaving process. The needle assembly 500 also includes the series of activation rods 513 that connect the needle 504 to the gears that synchronize the needle 504 with the cutting and knot tying process.

The needle positioning is enables the use of the cutter as disclosed, as the needle assembly 500 must be on the opposing side of the machine to enable the placement of the yarn onto the looper 362. When the fringe knots are being formed on a prewoven substrate, the substrate is positioned to run through the machine to enable the yarn needle 504 to interact with the middle of the substrate. Therefore, once the knots are formed, the material can be folded and secured to either side of the final produce. Alternatively, the knots can be formed on either side of a substrate strip and placement will be evident to those skilled in the art.

Packer System

Figure 18:
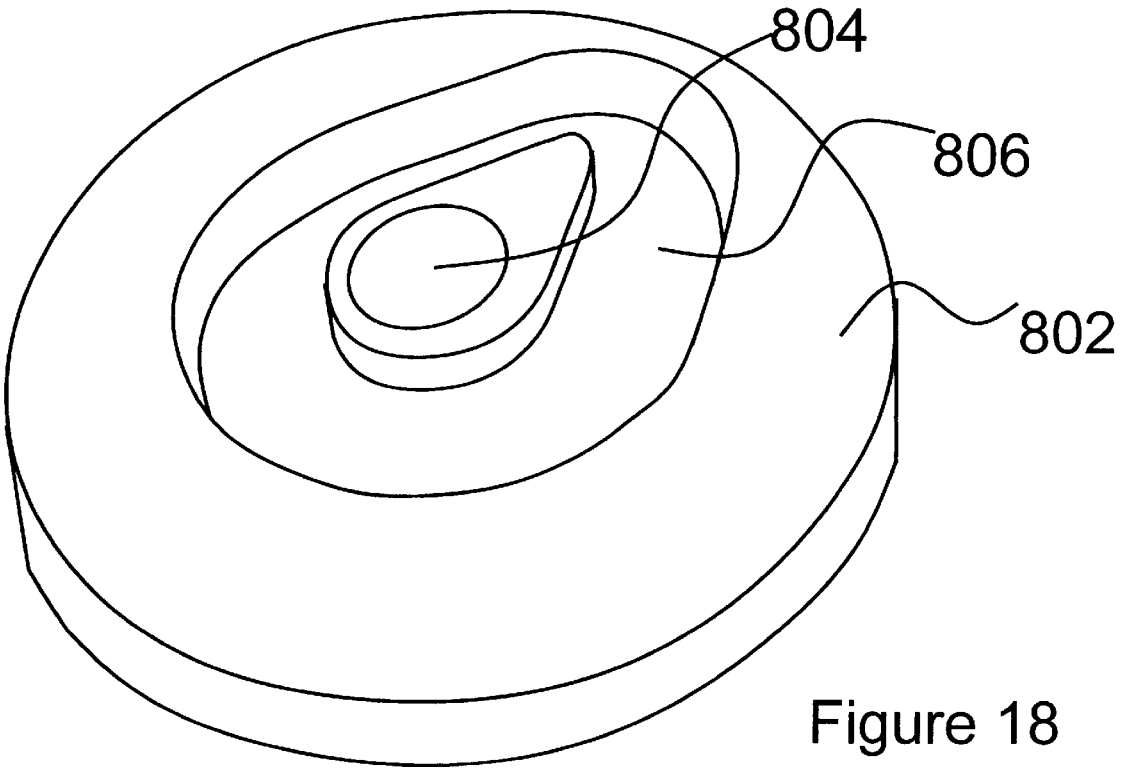
FIG. 18 is a perspective bottom view of the packer cam.

In FIG. 18 the packer cam 800 is illustrated. The packer cam 800 has a circular body 802 and receiving hole 804 as in standard cams. The packer cam 800, however has an egg shaped rotating recess 806 that causes the motion of the connected apparatus, in this case the packer reed 1002 illustrated in FIG. 23, to be erratic. This erratic motion, little or no movement during the broad portion of the egg shaped recess 806 and rapid, forceful motion during the narrow portion of the egg shaped recess 806, provides a snapping motion to the packer reed 1002. Percentage wise, the packing cam 800 causes the packer reed 1002 to remain motionless, or near motionless, about 75% of the time and active only 25% of each cycle. This snapping motion is required as the reed 1002 must compress the yarn 504 after each shift of the neddles 252 and 254 without obstructing the movement of the needle 502. Therefore, while the needle 502 is in the withdrawn position, the packer reed 1002 must compress the threads of yarn previously placed over the looper 362 and return to a position proximate the neddle 252 before the needle 502 starts the next weaving cycle. The curvature of the narrow portion of the egg shaped recess 806 controls how rapidly this compression process is completed and will be dependent upon the size of the machine and thickness of the yarn and will be evident to this skilled in the art.

The linkage between the packer cam 800 and the packer reed 1002 can be a pivot, arm or other method that enables the packer reed 1002 to have the rapid movement required to move the newly threaded yarn 504 into position and then move out of the way of the needle 502 to enable the next strand of yarn 504 to be woven.

Filler Hook Assembly

Figure 19:
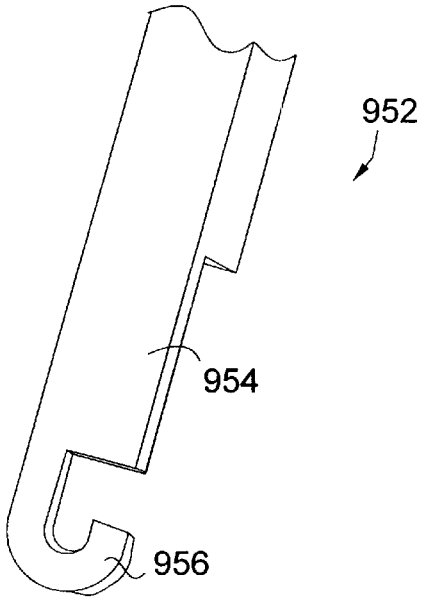
FIG. 19 is a perspective view of the filler hook.

In order to tie the knot, the ends of the yarn cut by the cutter assembly 350 must be held. This is accomplished by the filler hook 952 illustrated in FIG. 19. As can be seen in this Figure, the lower portion of the body 954 of the filler hook 952 forms a hook 956 that is dimensioned to receive the yarn 504. The filler hook assembly 950, illustrated in FIGS. 20–23 approaches the yarn 504 at an angle, grasps the yarn 504 within the hook 956 and then withdraws a predetermine distance. Te angle crates a tension in the yarn 504 as the filler hook 952 withdraws, however this tension should not be so great as to prevent the needle 158 from completing the knot by pulling the yarn 504 out of the hook 956.

Figure 23:
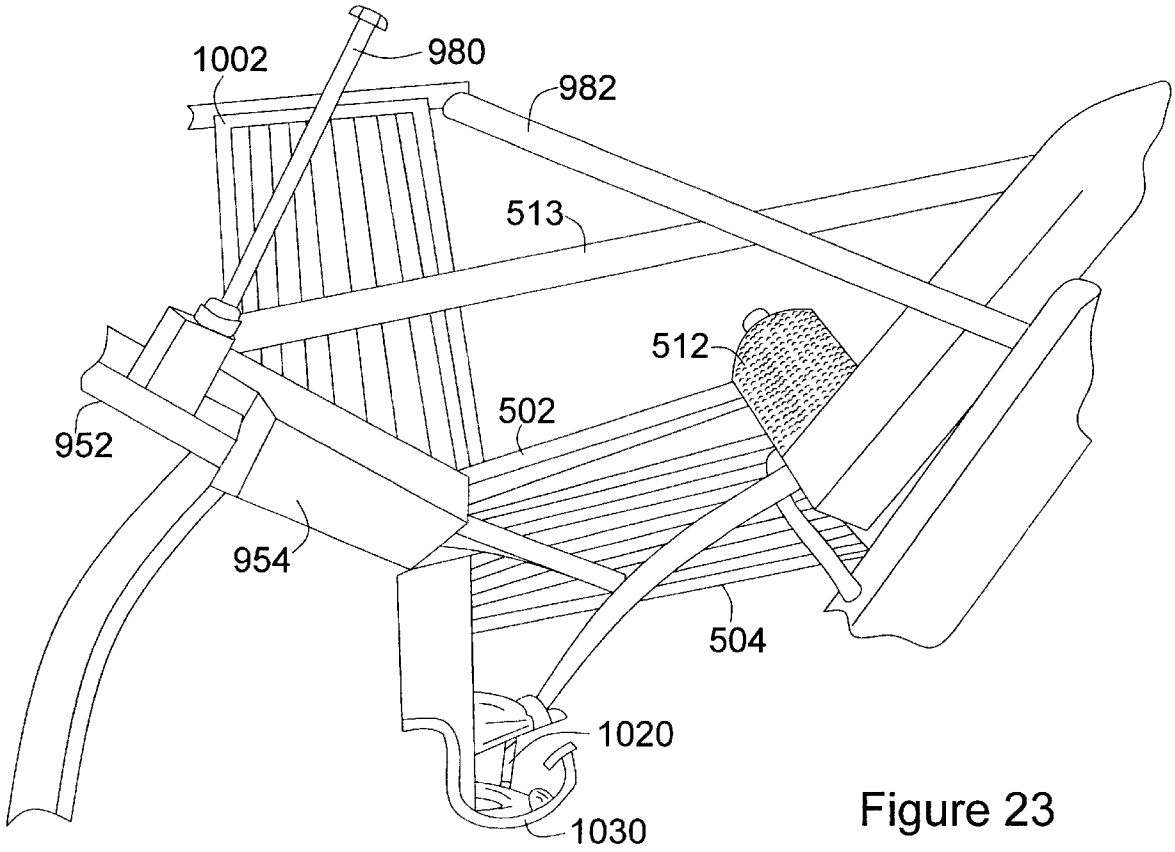
FIG. 23 is a perspective view of the knot tying process.

The body 954 of the filler hook 952, as seen in FIG. 23, further comprises a stop rod 980 that interacts with frame support 982. The stop rod 980 extends at right angles from the body 954 of the filler hook 952 and prevents the filler hook 952 from descending too far. The stop rod 980 comes in contact with the frame support 982 where it remains until the machine synchronization indicate that the filler hook assembly 950 withdraws to the next position.

U-Guide

The U-guide 1030 of FIG. 23 prevents the knots from moving upward, away from the rake 1020. The U-guide is positioned to be slightly above the plane of the knots to enable the knots to slide under the U-guide 1030.

Knotting Procedure

Figure 20:
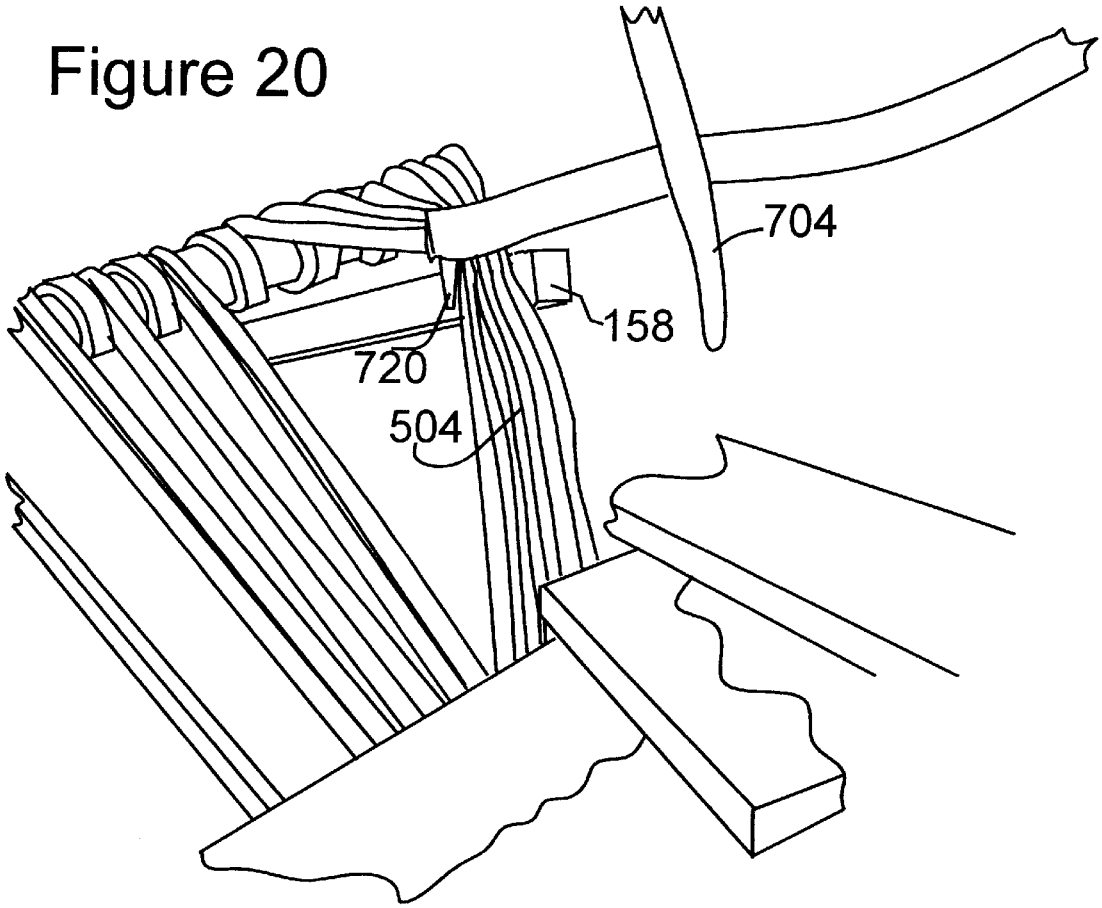
FIG. 20 is a perspective view of the picker gathering yarn.
Figure 21:
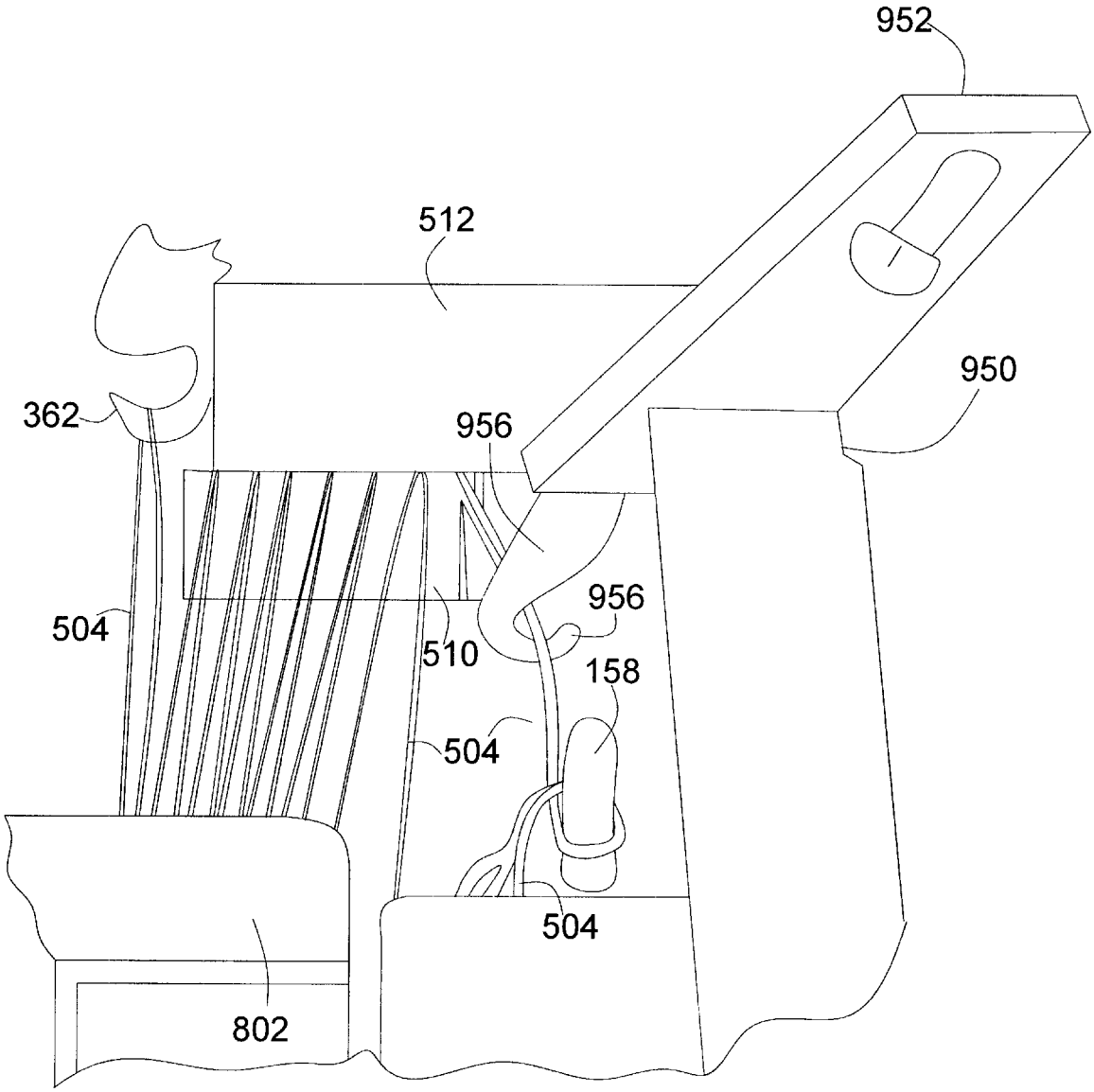
FIG. 21 is a perspective view of the initial process of knot tying.

In FIG. 20 the yarn pick 720 has pulled strands of yarn 504 into a cluster narrow enough to be grasped by the gripper on the needle 158 and the hook 956 of the filler hook 952. In this Figure the needle assembly 150 is starting its assent to bring to needle 158 into position to rotate and grasp the gathered yarn 504. Once the needle 158 has grasped in the yarn 504, the needle 158 rotates, as seen in FIG. 21, twisting the yarn 504 around the needle 158. The filler hook 952 also descends toward the gathered yarn 504 placing the hook 956 in position to grasp the gathered yarn 504. The filler hook assembly 950 then withdraws a sufficient distance to pull the yarn 504 from between the bristle roller 512 and the worm 510. Once the cut ends of yarn 504 are free and the needle 158 is ready to extend into the position illustrated in FIG. 22, the needle rod assembly 975 brings the needle rod 978 into contact with the twisted yarn 504. The needle rod 978 provides a stationary, solid point around which to form the knot and prevents the knot from collapsing in on itself prior to completion of the process. The needle rod 978 further prevents the twisted portion of the yarn 504 from sliding on the needle 158 shaft during the tying process. Once the needle 158 has ascended beyond the original twist, moving the twisted portion of the yarn 504 down the needle shaft, the needle 158 turns to bring the open eye 157 of the needle 158 into contact with the yarn 504. Once the yarn 504 is secured within the open eye 157, the needle 158 decends, pulling the ends of the yarn 504 through the twisted portion of yarn 504. The twisted portion of yarn 504 is prevented from simply sliding down by the needle rod by the needle rod 978. As the open eye 157 pulls the yarn 504 through, the knot tightener 172 is moved into contact with the forming knot. As the needle 158 pulls the yarn 504 through the knot tightener 172, the knot is tightened in accordance with the dimensions set on the knot tightener 172 as described in conjunction with FIG. 2.

As the needle 158 slides off the ends of the knot, thereby completing the knot, the rake 1020 engages the knot moving it under the U-guide 1030 toward the roller end 1032 of the machine 10, as shown in FIG. 1.

Prewoven Substrate

In FIG. 24 the prewoven substrate 1050 is fed through a substrate holder 1052 that maintains the substrate 1050 flat during the forming of the knot. The substrate holder 1052 has a needle receiving hole 1054 to receive the needle during the knot forming process.

Each of the actions within the machine are synchronized to interact with one another in exact timing. The gears, cams and belts illustrated herein are examples of the type that can be used and other parts will be evident to those skilled in the art.

What is claimed is:

1. A machine for tying knots onto a linear base material, said machine having initialization end and a completion end, the improvement comprising:

a cutter system, said cutter system being proximate the center of said machine and having a knife and a looper, said looper moving to a receiving position to receive threads of yarn from a needle and to a rest position to await a subsequent thread of yarn, and said knife moving to cut said yarn positioned on said looper;

a yarn needle, said yarn needle being on a first side of said machine and moving from said first side to said center of said machine, said yarn needle carrying yarn to said looper;

a roller assembly, said roller assembly having a bristle roller and a grooved worm, said bristle roller being in contact with said grooved worm, said grooved worm receiving yarn from said yarn needle and moving said yarn toward said completion end;

a picker assembly, said picker assembly extending from said completion end of said machine and pulling a predetermined number of yarn strands together;

a knot tying needle assembly said knot tying needle assembly being affixed at one end of a first side of said machine and having a movable needle with an open eye, said movable needle being extendable to a knot tying area proximate said roller assembly, a knot tightener, said knot tightener being positioned to interact with said movable needle and a rotating gear, said rotating gear rotating said movable needle in clockwise and counterclockwise directions;

a filler hook assembly, said filler hook assembly being movably affixed to said second side of said machine and moving to grab and lift said cut yarn from said roller assembly;

a needle rod, said needle rod contacting said movable needle and prevent said yarn from moving along said moveable needle while said knot is being tied;

a rake assembly, said rake assembly having a rake, said rake rotating around a wheel and being positioned come in contact with said tied knots and move said tied knots toward said completion end;

wherein said cutter assembly, said yarn needle, said roller assembly, said picker assembly, said knot tying needle assembly, said filler hook assembly, said needle rod and said rake assembly are synchronized with one another to tie fringe knots.

2. The machine of claim 1 wherein said linear substrate is a woven substrate from yarn.

3. The machine of claim 2 further comprising a neddle assembly to weave said substrate, said needle assembly having a pair of neddles, a rocker and an adjustable cam assembly, said adjustable cam assembly determining the movement of said needles in relationship to one another.

4. The machine of claim 3 further comprising a packer assembly, said packer assembly having a packer reed proximate said neddles for compressing threaded yarn into said woven substrate and a packer cam, said packer cam activating said packer reed to avoid contact with said yarn needle.

5. The machine of claim 1 wherein said looper and said knife move independent of one another through a series of clamp blocks and connecting links.

6. The machine of claim 1 wherein said filler hook assembly further comprises a stop rod, said stop rod prevent movement of said filler hook assembly beyond a predetermined distance.

* * * * *